US006370825B1

(12) United States Patent
Vollebregt et al.

(10) Patent No.: US 6,370,825 B1
(45) Date of Patent: Apr. 16, 2002

(54) EVENT CONSTRUCTION WITH MOVABLE PITCH

(75) Inventors: Johannes Adrianus Angelines Maria Vollebregt, Reeuwijk; Herman Bomer, Scharendijke; Alexander Gljsbert Van Der Meijden, Gouda, all of (NL)

(73) Assignee: Hollandsche Beton Groep N.V., Rijswijk (NL)

( * ) Notice: Subject to any disclaimer, the term of this patent is extended or adjusted under 35 U.S.C. 154(b) by 0 days.

(21) Appl. No.: 09/486,984

(22) PCT Filed: Sep. 7, 1998

(86) PCT No.: PCT/NL98/00511

§ 371 Date: May 8, 2000

§ 102(e) Date: May 8, 2000

(87) PCT Pub. No.: WO99/13161

PCT Pub. Date: Mar. 18, 1999

(30) Foreign Application Priority Data

Sep. 5, 1997 (NL) ..... 1006958

(51) Int. Cl.[7] ..... E04H 3/10; E01C 13/02; A63C 19/00

(52) U.S. Cl. ..... 52/6; 52/7; 52/64

(58) Field of Search ..... 52/6, 7, 64

(56) References Cited

U.S. PATENT DOCUMENTS

| | | | | |
|---|---|---|---|---|
| 3,867,805 A | | 2/1975 | Mikami et al. | |
| 4,497,764 A | | 2/1985 | Rey | |
| 5,187,894 A | * | 2/1993 | Ripley, Sr. et al. | 52/6 X |
| 5,682,711 A | * | 11/1997 | Warczak | 52/6 |
| 5,746,028 A | * | 5/1998 | DiBenedetto | 52/6 |

FOREIGN PATENT DOCUMENTS

| | | | | |
|---|---|---|---|---|
| DE | 2543176 | * | 4/1977 | 52/7 |
| EP | 0 000 587 | | 2/1979 | |
| GB | 2263644 | * | 8/1993 | |
| NL | 9300182 | | 8/1993 | |
| NL | 1001000 | | 4/1997 | |
| WO | WO 96/21700 | | 7/1996 | |

* cited by examiner

*Primary Examiner*—Laura A. Callo
(74) *Attorney, Agent, or Firm*—Young & Thompson

(57) ABSTRACT

An event construction comprises a public area, such as a grandstand, and a pitch for performing activities, for example sporting activities like football or baseball. The pitch is accommodated on a floor which by sliding elements is set up in such a way that it can be moved in relation to the public area. The sliding elements comprise at least one elongated track which is set up underneath the floor and is connected to the base or to the floor, and also supporting elements which are connected to the floor and can be slid in relation to the track, or supporting elements connected to the base, over which supporting elements the elongated track can be slid. Each track consists of mortar material.

21 Claims, 2 Drawing Sheets

EVENT CONSTRUCTION WITH MOVABLE PITCH

CROSS REFERENCE TO RELATED APPLICATION

This application is the 35 USC 371 national stage of International Application PCT/NL98/00511 filed on Sep. 5, 1998 which designated the United States of America.

FIELD OF THE INVENTION

The invention relates to an event construction, comprising a public area, such as a grandstand, and a pitch for performing activities, for example sporting activities like football and baseball, which pitch is accommodated on a floor which by means of sliding means is set up in such a way that it can be moved in relation to the public area, which sliding means comprise at least one elongated track which is set up underneath the floor and is connected to the base or to the floor, and also supporting means which are connected to the floor and can be slid in relation to the track, or supporting means connected to the base, over which supporting means the elongated track can be slid.

BACKGROUND OF THE INVENTION

Such a construction is known from NL-A-9300182. A number of steel elements are accommodated in the base, which elements serve as slide tracks. These elements support a number of feet of a casing containing a grass mat. Each foot has at its bottom end a PTFE-containing plastic sheet, which is slidable with low friction over the steel element.

On the one hand, the steel elements must be sturdily supported in the base, which can consist of, for example, a concrete foundation slab. On the other hand, small relative movements must be possible, in view of possible settlement and differences in expansion. The costs of such a construction are consequently relatively high.

SUMMARY OF THE INVENTION

The object of the invention is to provide a construction of the abovementioned type which does not have these disadvantages. That object is achieved by the fact that each track consists of mortar material.

The tracks made of mortar material can be manufactured in a simple manner with great accuracy as regards the levelness of the sliding surface, and consequently provide an even support for the floor situated above, in which a pitch is accommodated. It is possible to treat the surface area of the sliding surface after the mortar material has set, in such a way that the coefficient of friction is as low as possible. Such a treatment can be, for example, a polishing treatment.

An example which can be mentioned is a cast mortar based on plastic, such as an epoxy resin, which is preferably a two-component epoxy resin.

The mortar can also contain stony granules, such as sand or fine gravel, with a granule size between 0.25 and 4 mm. After the mortar material has set, it must have the maximum compression strength, which lies between 30 and 150 $N/mm^2$.

A reinforcement is preferably incorporated in the mortar material, in order to increase the maximum permissible tensile load of the mortar material. This gives the tracks good ability to withstand the tensile forces created in the tracks during shifting of the pitch The tracks of mortar material can be sunk in the base, such as a concrete slab. For that purpose, such a slab has a trench made in it, after which the reinforcement is placed in said trench and the mortar material applied.

Furthermore, each track of mortar material can be covered with a friction-reducing paint layer.

In order to rule out the possibility of such a paint layer peeling off as a result of rising damp, the mortar when it has set must be impermeable to vapour.

The paint layer can comprise a first coat and at least one top coat. This first coat and top coat can each consist of a two-component epoxy resin; the top coat can also contain wear-resistant pigments. After it has dried, the paint layer must preferably be able to withstand a maximum surface pressure which lies between 5 and 80 $N/mm^2$. In addition, in the pull-off test the value obtained for this layer must preferably lie between 0.5 and 20 $N/mm^2$.

The thickness of the first coat preferably lies between 30 and 50 $\mu$m; that of a top coat between 120 and 350 $\mu$m.

Two or more top coats can also be provided, the total thickness of the paint layers lying between 150 and 7000 $\mu$m. It is also possible to reverse the elongated track and the supporting means; the supporting means can be placed in or on the foundation slab, and the elongated track can be fixed to and/or manufactured on the underside of the movable floor.

Another variant can consist of the supporting means comprising elongated tracks, the sliding surface part of which is also made of mortar material, which can further be provided with a friction-reducing paint layer. In this variant both sliding surfaces can be made of mortar material.

BRIEF DESCRIPTION OF THE DRAWINGS

The invention will now be explained in greater detail with reference to an exemplary embodiment shown in the figures.

DETAILED DESCRIPTION OF THE INVENTION

Figure 1:
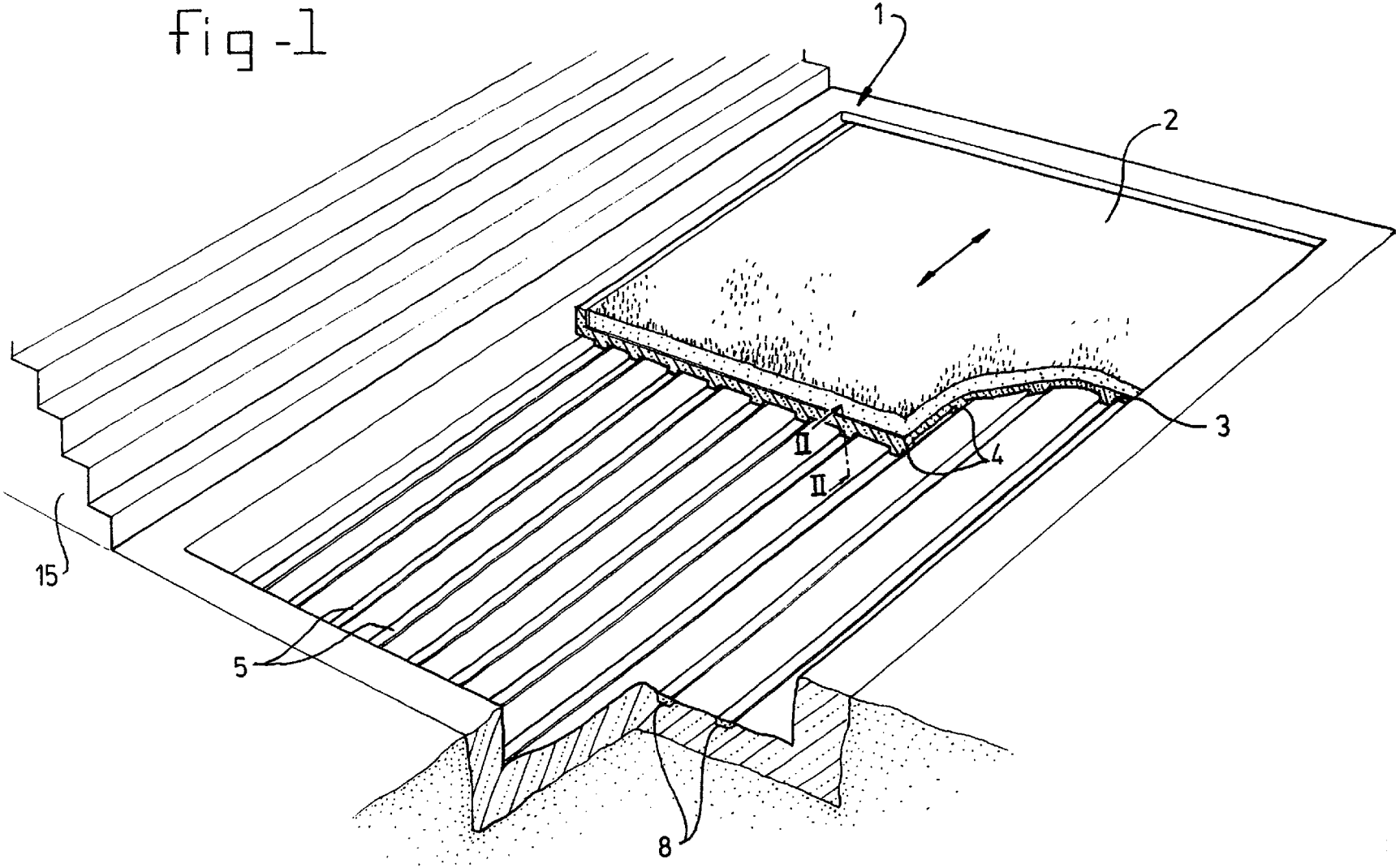
FIG. 1 shows a diagrammatic view of the construction according to the invention, in perspective and partially in section.

The event construction according to the invention shown in FIG. 1 is in the form of a football pitch or hockey pitch. The construction comprises a casing 1, in which a pitch 2 is accommodated. Said pitch 2 in the usual manner consists of sand and earth and a water drainage system, on which a grass mat is placed. The pitch 2 rests on the movable floor 3, which forms part of the casing 1.

By means of a number of feet 4, fixed to the floor 3, the casing 1 is supported on a number of elongated tracks 5.

In the playing position of the movable pitch 2, a grandstand 15 for spectators can be fitted in the vicinity of the pitch 2.

Figure 2:
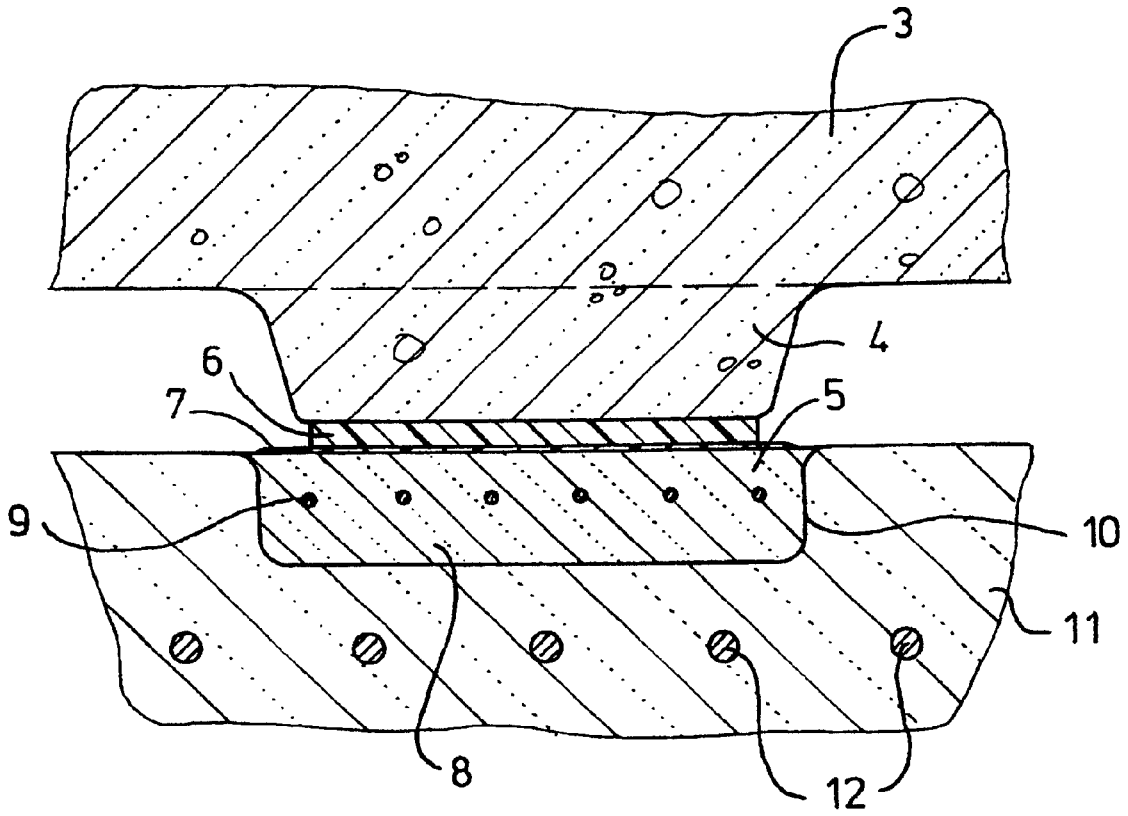
FIG. 2 shows a detail according to II—II of FIG. 1.

As shown in FIG. 2, the underside of each foot 4 is provided with a layer of teflon 6. The tracks 5 are provided on their top surface with a paint layer 7. The teflon sheets 6 and the paint layer 7 have a low coefficient of friction relative to each other. Said low coefficient of friction can be reduced even further by applying grease and/or oil between the contact faces of teflon sheets 6 and paint layer 7. As a result of this, the pitch 2 can be slid in the casing 1 in the direction of the arrow in FIG. 1 by means of piston/cylinder devices (not shown).

The tracks 5 according to the invention each consist of a mortar, for example a cast mortar 8 based on an epoxy resin, in which a reinforcement 9 is incorporated.

The tracks 5 are accommodated in trenches 10 of the base 11. The base 11 can be made of concrete in which a reinforcement 12 can be incorporated.

What is claimed is:

1. An event construction, comprising:

a public area for viewing activities;

a pitch for performing said activities; said pitch being accommodated on a movable floor over a base;

sliding means structured and arranged to move the pitch in relation to the public area; said sliding means comprising at least one elongated track located underneath the movable floor and connected to at least one of the base and the movable floor;

each elongated track comprising mortar material which is covered with a friction-reducing paint layer; and supporting means connected to at least one of the movable floor and the base, and structured and arranged to slide in relation to the track.

2. The construction according to claim 1, wherein the mortar is a cast mortar based on at least one of plastic and cement.

3. The construction according to claim 2, wherein the cast mortar is based on epoxy resin.

4. The construction according to claim 3, wherein the epoxy resin is a two-component resin.

5. The construction according to claim 1, wherein the mortar contains stony granules having a granule size between 0.25 and 4 mm.

6. The construction according to claim 1, wherein the mortar is impermeable to vapor after setting.

7. The construction according to claim 1, wherein after setting, the mortar has a maximum compression strength ranging between 30 and 150 $N/mm^2$.

8. The construction according to claim 1, further comprising a reinforcement incorporated in the mortar material, in order to increase the maximum permissible tensile load of the mortar material.

9. The construction according to claim 8, wherein the reinforcement comprises bars extending in the lengthwise direction of the track.

10. The construction according to claim 1, wherein each track made of mortar material is recessed in the base or the bottom of the floor.

11. The construction according to claim 1, wherein after drying, the paint layer can withstand a surface pressure ranging between 5 and 80 $N/mm^2$.

12. The construction according to claim 1, wherein after drying, the paint layer can withstand a pull-off strength ranging between 0.5 and 20 $N/mm^2$.

13. The construction according to claim 1, wherein the paint layer comprises a first coat and at least one top coat.

14. The construction according to claim 13, wherein the first coat and each top coat comprises a two-component epoxy resin.

15. The construction according to claim 14, wherein said at least one top coat contains wear-resistant pigments.

16. The construction according to claim 13, wherein the first coat has a thickness ranging between 30 and 50 $\mu$m.

17. The construction according to claim 13, wherein said at least one top coat has a thickness ranging between 120 and 350 $\mu$m.

18. The construction according to claim 13, wherein two top coats are provided, and the total thickness of the paint ranges between 150 and 7000 $\mu$m.

19. The construction according to claim 13, wherein two top coats are provided, and the total thickness of the paint layers ranges between 150 and 500 $\mu$m.

20. The construction according to claim 1, wherein the supporting means comprise a foot having an underside and a top side; said foot being covered at least on the underside or on the top side with a PTFE-containing plastic.

21. The construction according to claim 1, wherein each track consists exclusively of mortar material and a paint layer.

* * * * *